US009022172B2

(12) United States Patent
McCarthy et al.

(10) Patent No.: US 9,022,172 B2
(45) Date of Patent: May 5, 2015

(54) LADDER ACCESSORY

(71) Applicants: William Edward McCarthy, Bay City, MI (US); Derron Alan Suchodolski, Bay City, MI (US)

(72) Inventors: William Edward McCarthy, Bay City, MI (US); Derron Alan Suchodolski, Bay City, MI (US)

( * ) Notice: Subject to any disclaimer, the term of this patent is extended or adjusted under 35 U.S.C. 154(b) by 0 days.

(21) Appl. No.: 13/998,577

(22) Filed: Nov. 13, 2013

(65) Prior Publication Data

US 2014/0209411 A1 Jul. 31, 2014

Related U.S. Application Data

(60) Provisional application No. 61/848,678, filed on Jan. 9, 2013.

(51) Int. Cl.

| | |
|---|---|
| ***E06C 7/00*** | (2006.01) |
| ***E06C 7/16*** | (2006.01) |
| ***E06C 1/34*** | (2006.01) |

(52) U.S. Cl.

CPC ... *E06C 7/00* (2013.01); *E06C 7/16* (2013.01); *E06C 1/345* (2013.01); *E06C 7/165* (2013.01)

(58) Field of Classification Search

CPC ..... E06C 7/165; E06C 7/16
USPC ..... 182/120–122
See application file for complete search history.

(56) References Cited

U.S. PATENT DOCUMENTS

| | | | | |
|---|---|---|---|---|
| 966,244 | A * | 8/1910 | Ruck | 248/238 |
| 1,886,921 | A | 11/1932 | Tobin | |
| 4,279,327 | A | 7/1981 | Warren | |
| 4,531,613 | A | 7/1985 | Keigher | |
| 4,770,272 | A | 9/1988 | Riley | |
| 4,800,988 | A | 1/1989 | Dunmore | |
| 4,901,818 | A | 2/1990 | Schmitt | |
| 5,099,952 | A * | 3/1992 | Farrell | 182/122 |
| 5,111,908 | A * | 5/1992 | Reiter et al. | 182/92 |
| 5,388,665 | A * | 2/1995 | Newman | 182/122 |
| D365,156 | S | 12/1995 | Strickler | |
| 6,148,957 | A | 11/2000 | Ahl | |
| 2007/0068732 | A1* | 3/2007 | Nagle | 182/121 |
| 2011/0011676 | A1* | 1/2011 | DeLair | 182/129 |

* cited by examiner

*Primary Examiner* — Alvin Chin-Shue
(74) *Attorney, Agent, or Firm* — Mitchell Intellectual Property Law, PLLC

(57) ABSTRACT

A ladder accessory that is used with a ladder that extends out from the side of the ladder to provide footing for a worker. The accessory comprises an elongated rectangular open box structure defining at least one set of two parallel ladder rail channels that are placed crosswise (perpendicular) to the length of the box structure and are spaced apart a distance such that one of said channels can engage one rail of a ladder and the other channel can engage the other rail and both channels engage a rung. The rectangular elongated box defines two side walls that contain single hook key slots that can be engaged with rungs of the ladder when the accessory is placed lengthwise parallel to the rails of the ladder and, with a rung lock mechanism, can be fastened to the ladder and carried with the ladder.

4 Claims, 12 Drawing Sheets

LADDER ACCESSORY

CROSS REFERENCE TO RELATED PATENT APPLICATION

This application claims the benefit of the filing date of U.S. Provisional Application No. 61/848,678, filed Jan. 9, 2013, the teachings of which are incorporated herein by reference.

FIELD OF INVENTION

The invention relates to an accessory that attaches to a ladder to provide additional footing and safety for workers on pitched roofs and which in one embodiment can also be attached lengthwise between the rails of a ladder for carrying purposes.

BACKGROUND OF THE INVENTION

Ladders are used on pitched roofs for many purposes, e.g. shingling, roof repair, chimney repair and the like. One particular use is ventilation during fire fighting. This is the systematic removal of smoke and heated fire gases from a burning structure. Ventilation is performed in four basic situations. These situations include fire control, fire attack, rescue and overhaul. Firefighters have a choice of basic ventilation types to accomplish the objectives of these situations. The basic types are vertical, horizontal, and forced ventilation.

Vertical ventilation is allowing heat and smoke to travel upwards and out of a structure. This is performed by cutting vents or making use of existing openings in the roof of the structure. To accomplish vertical ventilation requires many resources. At a minimum, these resources include two well-trained and fully protected firefighters, cutting equipment, ladders, and a charged water line. Once these resources have been assembled and moved to the roof, vertical ventilation normally involves first opening existing openings and then making roof cuts as close as safely possible to the seat of the fire. Firefighters making roof cuts know one large vent is more effective than several small vents and once vertical ventilation is completed, return immediately to the safety of the ground.

The advantage to vertical ventilation is found in basic fire behavior. Due to convection, the first choice of heat is to travel straight up. Vertical ventilation allows this natural movement to occur and is, consequently, the most effective form of ventilation. When vertical ventilation is properly performed, it can greatly reduce the mushrooming of gases and improve the conditions inside the structure. There are several disadvantages to vertical ventilation. First, firefighters are subjected to all the dangers of being on the roof of a structure. These include structural collapse, disorientation, and falls. Second, vertical ventilation takes time to perform and is often impractical. Many roofs are extremely difficult to breach and fires not on the top floor may see little benefit to the operation. Third, as described above, vertical ventilation demands many resources. Most departments do not initially have the firefighters necessary to perform vertical ventilation in the early stages of an incident. Even though these disadvantages exist, sometimes, vertical ventilation is preferred.

When fire departments have adequate personnel, vertical ventilation and other operations can be performed simultaneously. Departments that do not have these resources must still recognize when vertical ventilation can assist the operation. Of the four situations discussed, fire control is most accomplished with vertical ventilation. Fire attack, rescue, and overhaul have other ventilation options that departments with limited personnel can perform. The objective of fire control is to stop the horizontal spread of the fire and vertical ventilation makes this possible. This is especially true with attic fires and fires in balloon construction.

Although it will often be too dangerous to vent an attic fire, fires in balloon construction can benefit from early vertical ventilation. Fires that have penetrated into the walls of such structures will quickly travel to the attic. From there, the fire will rapidly spread throughout the structure. If vertical vents have been placed early, before the fire has weakened the roof, the effects of fire spread will be reduced.

The device of this invention is a ladder accessory that is easily attached to a roof ladder that provides additional footing support thus making the creation of vertical ventilation easier and safer. The invention is used in aiding firefighters to cut holes in the roofs of burning buildings to provide ventilation as described hereinbefore. In conventional firefighting procedure, where the roof of a building is exposed to the fire, it is necessary to open a hole in the roof so the smoke and flame will be concentrated there rather than weakening the entire roof. This also creates an updraft that has a tendency to clear the windows and doors of smoke so the firefighter may evacuate persons trapped in the building and they may enter the building to fight the fire.

In making such an opening it has been the practice to use a single roof ladder hooked over the ridge of the roof. The firefighter must then lean over and chop or cut a hole near the side of the ladder. This is a very awkward and dangerous procedure. He may have to leave one foot on the ladder and put one foot on the roof. Sometimes the fire fighter will drive the pick end of his axe into the roof to provide a support for one of his feet. This is unsafe and the fire fighter may need his axe.

In another technique the firefighter may be assisted by a second fire fighter who uses a Halligan/Trash tool or hook to enable the fighter cutting the hole to brace one of his feet. These tools need to be embedded into the roof while the present invention does not. As an improvement to this method the apparatus of U.S. Pat. No. 4,901,818 has been suggested. However this requires using two ladders and a large cumbersome platform suspended between the two ladders. Often there is not sufficient room to place two ladders, or not a sufficient number of firemen to place the ladders and the platform.

By a unique and simple design the ladder step accessory of the present invention may be used with a conventional ladder to form a safe support for the second foot of the fireman. The invention improves cutting a hole in the roof. The versatility of the present invention also makes it useful for combating chimney fires, fire rescue out of dormer windows, marking roof edge during dark and or under smoky conditions thus preventing slipping off of a roof, as a tool catch to prevent tools from sliding off a roof, operations platform for working on fascia and soffits and the like. The device may also be used for other roof maintenance projects such as repairs, shingling, chimney work and the like.

Several devices have been suggested which support either a step or a scaffold from one or more ladders. U.S. Pat. No. 4,279,327 (Warren) and U.S. Pat. No. 4,531,613 (Keigher) are two patents that relate to firefighting but show a single ladder has an extension at the top that is wide enough to embrace the area where the hole is made. These two patents show devices that limit the firefighter to the area where the ladder has been hooked and place him/her directly over the cut to be made in the roof Moreover they are cumbersome and require the attachment be made a part of the ladder. This then requires additional large equipment to be carried by the fire truck. In U.S. Design Pat. No. 365,156 a foot holder is suggested that requires using a pin to attach an arm that is not braced. This can be a very cumbersome and difficult for a fireman to attach to a ladder.

None of the art provides a ladder accessory that can also be carried on the ladder rungs in a vertical position parallel to the ladder rails that adds further convenience and safety for workers. This also reduces the need for additional manpower. For example FIG. 8 of U.S. Pat. No. 5,099,952 shows the need for a worker to carry the device illustrated there slung over his shoulder. This is cumbersome especially if the worker also needs to carry other tools.

SUMMARY OF THE INVENTION

The device of the present invention is an accessory (device), i.e. a step (safety platform), that can be fitted to a standard roof ladder comprising two rails that support multiple rungs. The invention enables firefighters and other workers to work on pitched roofs by increasing the support they have and minimizing the potential dangers by giving the firefighters and workers a secure step or foothold.

The device comprises an elongated rectangular open box structure having a height, width and length defining at least one set of two parallel ladder rail channels that are placed perpendicular (crosswise) to the length of the box structure and that are spaced apart a distance such that one of said channels can engage one rail of a ladder and the other channel can engage the other rail of the same ladder to provide a secure fit with the ladder. The channels open to the bottom of the accessory. The rectangular elongated box defines two side walls and a top face said side walls having a height at least as high as the rails of said ladder. Each of the channels comprises an inner wall and outer wall wherein each inner wall faces and runs parallel to the other inner wall and each defines a double hook key slot that are aligned with each other so the double hook key slots can engage a rung of a ladder thereby hooking the rung and said ladder to said accessory when the rail channels are placed over the opposite rails of the ladder. The length of the accessory is greater than the width of the ladder thereby having a portion of the accessory extending essentially perpendicularly beyond the width of said ladder to provide a supporting surface when the accessory is engaged with the ladder. The top face of the accessory preferably defines at least one opening sized to permit a human foot to rest within the opening and or provide access to the interior of the box structure to for example to adjust a rung lock mechanism provided inside. Open box structure means that the accessory is sufficiently open from the inside to outside that water or debris does not become entrapped inside.

Referring to FIG. 1 the ladder step accessory 10 comprises an elongated strong open rectangular box structure 14, having a top face 31 and two side walls 29 and 30. The box structure defines at least two ladder rail channels, 11 and 11*a*. The rail channels are positioned parallel to each other and crosswise to the length of the box structure and spaced apart such that one channel engages a rail of a ladder while the second channel engages the other rail of the ladder to provide a secure fit with the ladder. The channels are positioned crosswise to the length of the box structure. In the shown embodiment the rail channels are positioned at one end of the accessory. They may however be placed and properly spaced apart anywhere along the length of the accessory. If the channels are placed towards the middle of the accessory, a portion of the accessory extends from each side of the ladder. Each of said channels defines an inner wall, 26 and 27, and an outer wall, 25 and 28. Defined in each inner wall is a double hook key slot, 13 and 13*a*, that are aligned with each other and permit the engagement (hooking) with a rung of a ladder when the accessory is extended from either the left or right side of the ladder and extends horizontally (e.g. perpendicular) outwardly from the ladder as shown for example in FIGS. 5, and 9. When so positioned the accessory is said to be engaged with a ladder in the "working mode". When engaged in the working mode the accessory extends a distance from the side of the ladder to provide additional foot support for a worker or may support tools, pails or the like. The double hook key slots enable the accessory to be secured to extend from either the left or the right side of the ladder or from both sides if the rail channels are placed toward the center of the accessory.

In one embodiment the parallel side walls 29 and 30 define sets (pairs) of hook key slots, 12, (in the embodiment shown and described herein 3 sets (pairs) of single hook key slots are shown) that are aligned across from each other and open to the bottom of the side walls. Each pair is designed to engage a rung of a ladder when the bottom of the accessory is placed on the rungs with the side walls running parallel to the rails of a ladder. Double hook key slots can also be used. This arrangement is referred to herein as the accessory being engaged with a ladder in the "carrying mode". The length of the accessory will determine how many sets of hook key slots are necessary. The basins of the hook portion of single hook key slots shown in the Figures all face in the same direction,—i.e. towards the end of the accessory containing the foot guard 16. If desired the accessory could be made with all the single hook key slots in the side walls facing in the other direction. As mentioned double hook key slots can be used. When hook key slots are provided in the side walls the accessory preferably is also provided with a rung lock mechanism such as for example the embodiment 17 shown in the Figures and described herein. The rung lock mechanism is used to lock one rung in a pair of aligned hook key slots (single hook key slots shown and described herein) which because of the spacing between the pairs of hook key slots (same as distance between the rungs) locks other rungs engaged with the other pairs of single hook key slots. This will then provide a secure attachment of the accessory to a ladder when it is desired to use the accessory in the carrying mode. When double hook key slots are defined in the side walls a locking mechanism is provided as part of the accessory to lock at least one rung which is seated in either of the hook portions of the hook key slot. When a rung lock mechanism is provided in the interior of the accessory the top face of the 31 of the accessory may also define an opening to permit a worker access the rung lock. The device of the instant invention is designed to be used when a ladder is hung over the peak or ridge of a roof for a firefighter or worker to work on a pitched roof.

DESCRIPTION OF THE DRAWINGS

The drawings illustrate an embodiment of the invention for illustrative purposes but the invention is not limited thereto. Not all identical parts are numbered but should be considered as the same as the numbered part. Likewise the drawings may not be proportionately identical but still disclose the claimed invention.

FIG. 13*a*, the foot guard 16: FIG. 13*b*, the outer wall of rail channels, 25 and 28 (only one shape is shown since they may be identical); FIG. 13*c*, the shape of the inner wall of rail channel, 26 and 27 (only one part is shown since they can be duplicate of each other) having the double hook key slots, and FIG. 13*d*, brace 19 cut to fit the embodiment of the accessory having internal braces 35 and 36 shown in FIG. 3. The shape of the outer wall of the channel includes a vertical wall portion and an extension off the bottom used to aid in attaching the walls to the rectangular box structure and form the top of the channel.

DETAILED DESCRIPTION OF THE INVENTION

Figure 1:
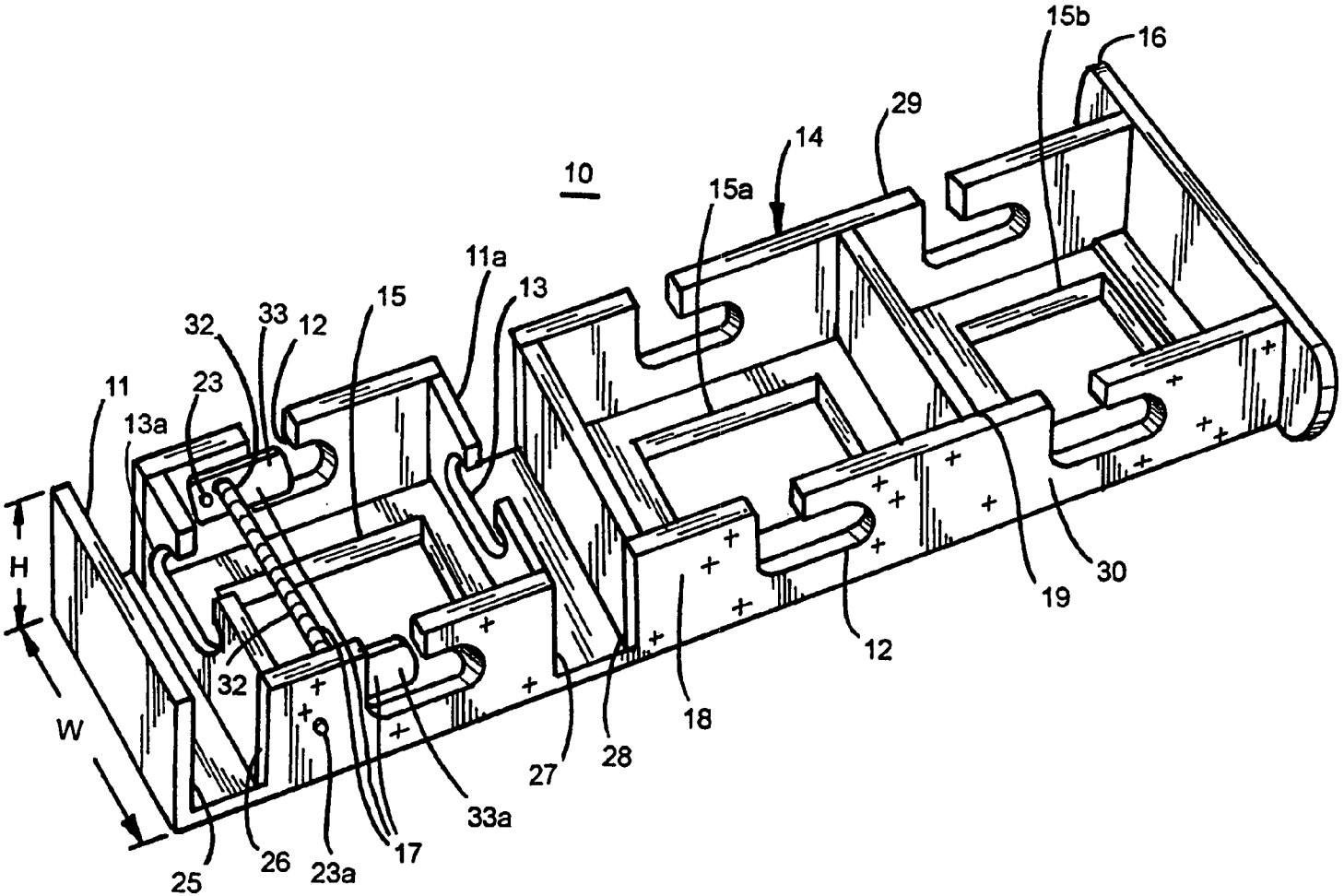
FIG. 1 is an isometric view looking at the bottom of the open rectangular box structure of one embodiment of the invention. This embodiment does not include the lips 37 and 37*a* running along the bottom of the side walls 29 and 30 that are shown in other Figures.

In the FIG.s and the specification the following numbers have the descriptions set forth below. Not all like parts in the Figures are numbered but will have the same definitions:

10—Ladder accessory-referred to in some places merely as accessory
11 and 11*a*—Ladder rail channels formed in the accessory
12—Single hook key slots
13 and 13*a*—Double hook key slots
14—Rectangular open box structure
15, 15*a*, 15*b*—Openings positioned in the top face 31 of the open box structure to secure footing of user and or to permit access to the interior of the box structure
16—Foot guard
17—Rung lock mechanism
18—non-skid elements on surface of accessory
19—Internal brace
20—Ladder rung
21 and 21*a*—Ladder rails
22—Spring
23 and 23*a*—Pivot points in rung lock mechanism 17 and side walls 29 and 30, for example matching bores are made in the key locks and side walls and are pivotally attached with suitable fasteners
24—Ladder roof peak hook
25—Outer wall of rail channel 11
26—Inner wall of rail channel 11
27—Inner wall of rail channel 11*a*
28—Outer wall of rail channel 11*a*
29 and 30—Parallel side walls of rectangular open box structure 14
31—Top face of rectangular open box structure 14
32—Handle of lock mechanism 17
33, 33*a*—Lock keys of lock mechanism 17
34—Ladder
35, and 36—inside bracing running parallel to length of the accessory on the inside of face 31
37, 37*a*—Lips extending from the bottom edge of each side wall along the length of the accessory except for open spaces of the single hook key slots and rail channels positioned in the side walls.

Referring to FIG. 1 the ladder accessory 10 comprises a strong open rectangular box structure 14 that defines at least two ladder rail channels, 11 and 11*a* that open to the bottom of the accessory and have a roof along the underside of the top face 31 of the accessory. The rail channels are positioned parallel to each other running crosswise to the length of the box structure, having a width and depth and spaced apart a distance such they individually engage with both of the opposite ladder rails of the same ladder to provide a secure fit to the ladder. The exact distance between the rail channels will depend on the width of the ladder and thus the distance between the ladder rails. Most ladders are manufactured to standard specifications, especially ladders used for common purposes such as fire fighting and the like. In the shown embodiments the rail channels are positioned at one end of the accessory. They may however be placed and properly spaced apart anywhere along the length of the accessory. If placed towards the center of the accessory, when placed on a ladder a portion of the accessory will extend from both sides of the ladder. Each of said channels defines an inner wall, 26 and 27, and an outer wall, 25 and 28. Defined in each inner wall is a double hook key slot, 13 and 13*a*, which are aligned with each other and sized to accept a ladder rung of a specific size thus permitting the engagement (hooking) with a single rung of a ladder when the rail channels of the accessory are engaged with the rails of the ladder and the ladder extends from either the left or right side of the ladder. The accessory can be extended horizontally (e.g. perpendicular) from a ladder as shown for example FIGS. 5 and 9. The accessory when in this position is said to be attached in the "working mode". The side wall of the accessory facing up will provide a supporting surface.

The box structure also defines two parallel side walls 29 and 30. The side walls define sets (pairs) of opposing single hook key slots, 12, (in this embodiment, 3 sets), that are aligned across from each other and sized so they can engage rungs of a ladder when the accessory is placed on the rungs with the side walls 29 and 30 running parallel to the rails of a ladder. This arrangement is referred to herein as the accessory being engaged with a ladder in the "carrying mode". The length of the accessory will determine how many sets (pairs) of single hook key slots are necessary. When placed in the carrying mode the rungs are preferably locked into the single hook key slots with a locking mechanism, such as, for example the rung lock mechanism 17 shown in the Figures and described herein.

Figure 2:
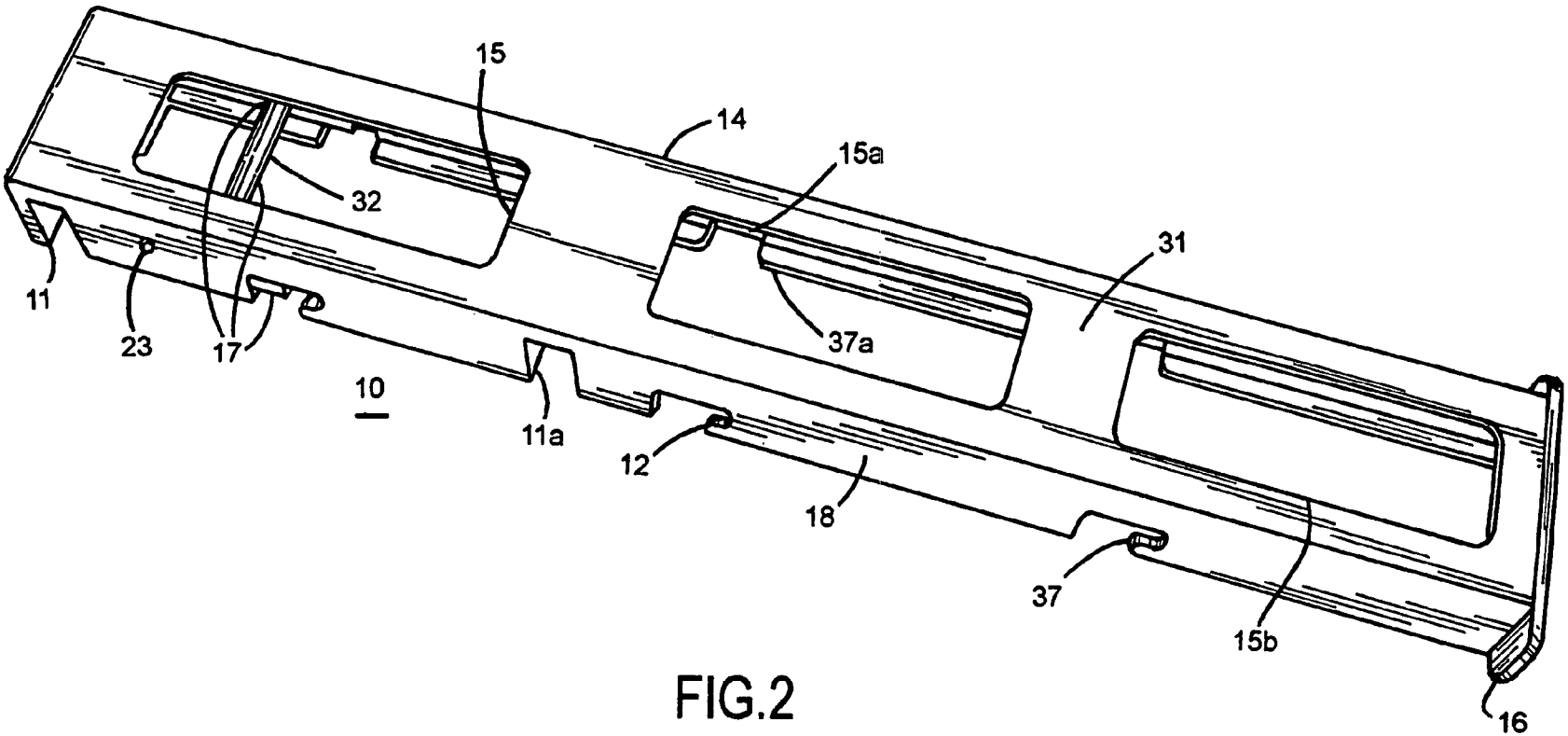
FIG. 2 is a top side view of the invention.

The top face (FIGS. 2, 31) of the rectangular open box structure preferably defines at least one opening that functions to provide an additional foot support (step) 15 for a worker and or access of a workers hand to for example operate a rung lock mechanism. The openings also provide a place for the worker to easily grasp and hold the accessory during engaging and disengaging it form a ladder. In the illustrated mode the face defines three such open foot supports, 15, 15*a* and 15*b*.

The ability of the accessory (device) to be attached to a ladder in the carrying mode provides several advantages. It provides a means for storing the device on fire truck ladder; it enables the device to be carried to the roof along with the ladder thus not requiring an individual to carry the device. Other advantages include the fact that the embodiment having the foot openings can be left in the carrying mode while a ladder is on the pitched roof and workers can still climb up or down the ladder using the foot openings.

The width (W) of the rectangular box structure can vary but is preferably limited by the distance between the parallel rails of the ladder so that the accessory preferably can also be used in the carrying mode. The height (H) of the accessory can also vary but in a preferred embodiment is substantially the same height as the height of the rails of the ladder it is to be used with. The length of the accessory can also vary but for stability purposes is normally no longer than about four or five feet. The floor (bottom) of double hook key slots 13 and 13*a* are placed at a height such that when the accessory is engaged with the ladder rails and rung in a working mode the bottom of the accessory rests on the roof surface in substantially the same plane as the bottom of the rails of the ladder.

As illustrated in FIG. 1 and some other Figures one embodiment of the accessory also includes a foot guard 16 located at the end of the accessory extending away from the ladder. The foot guard functions to assist in preventing the foot of a worker standing on the accessory from accidently slipping off the end of the accessory. The foot guard width is greater than the width of the accessory. The height of the foot guard is normally about the same as the height of the accessory but can have a greater height if desired. If the accessory is designed such that it extends from both sides of the ladder two foot guards are preferably made part of the device, one located at each end of the accessory.

Figure 7:
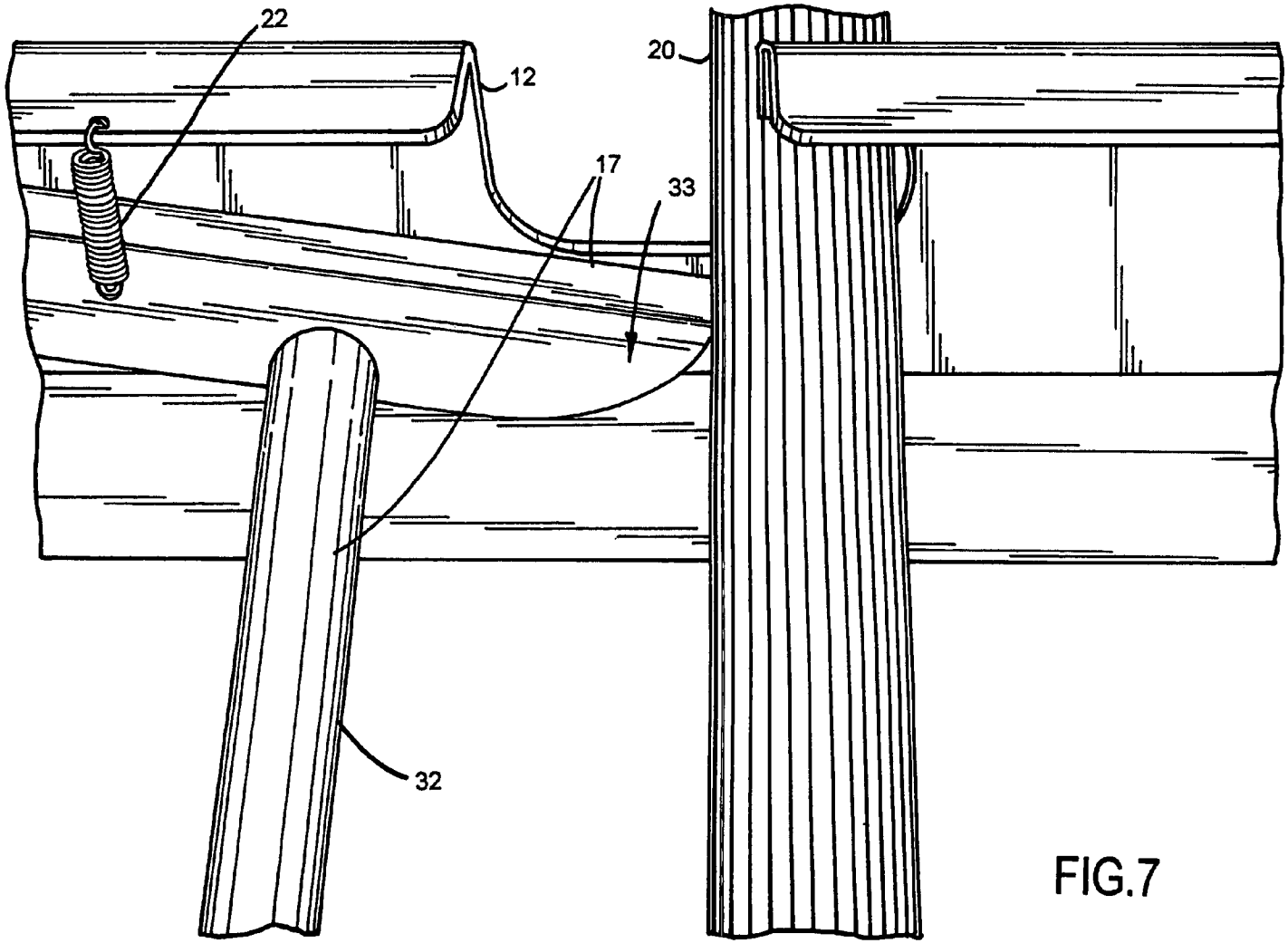
FIG. 7 is a close-up bottom view of a portion of the accessory showing the locking mechanism 17 and the single hook key slot 12 used when the accessory is hooked onto a ladder in a carrying position, the accessory running parallel with the rails of the ladder as shown in FIG. 10, for example, just before the rung seats in the single hook key slot and the rung lock mechanism 17 closes.
Figure 8:
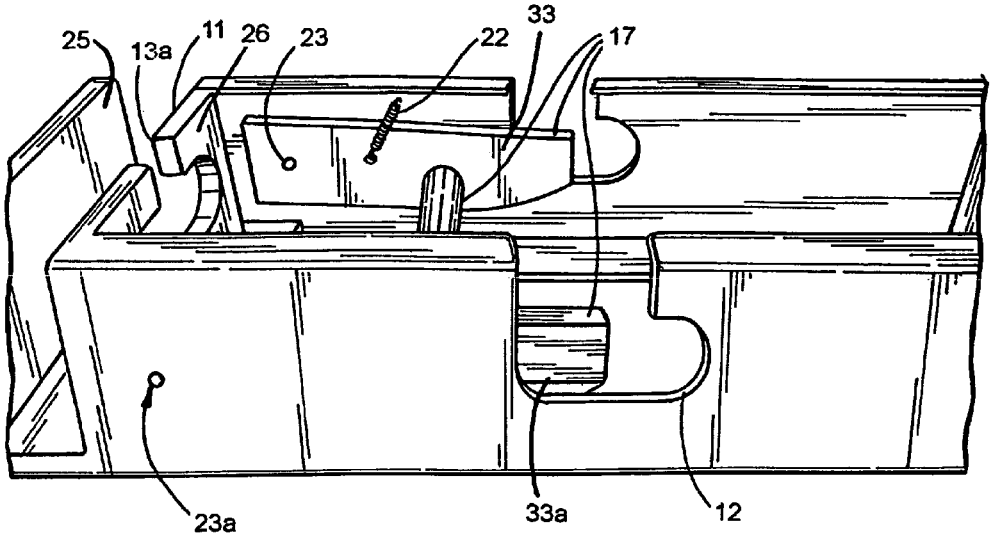
FIG. 8 is a close-up side/bottom view of a portion of the accessory illustrating further detail of the rung lock mechanism 17 in a closed position. A ladder rung is not shown in this Figure.
Figure 11:
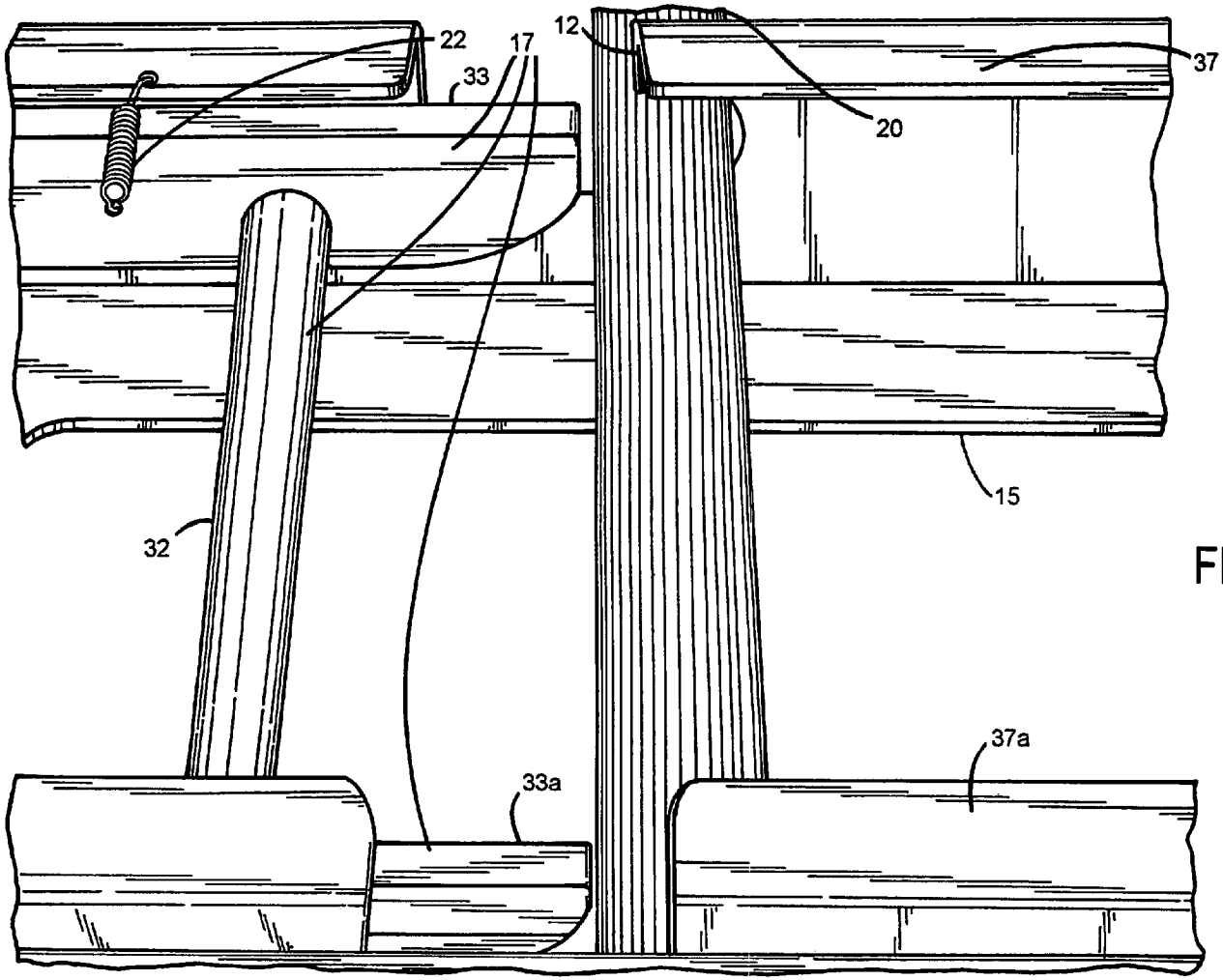
FIG. 11 illustrates a close-up bottom view of a portion of the accessory showing a rung in place with a pair of the single hook key slots with the accessory in the carrying mode with the rung lock mechanism 17 in locked position and the ladder rung secured in the basin of both of the single hook key slots located in the opposite side walls and aligned to each another. When locked in this position the other pairs of side wall single hook key slots will also be locked on other rungs of the ladder.

The accessory may also include a rung lock mechanism 17 that functions when the accessory is in the carrying mode to lock at least one rung of a ladder in a set (pair) of aligned hook key slots 12, preferably comprising single hook key slots. The rung lock mechanism can be activated and deactivated and should not interfere with the accessory when placed on a ladder in the working mode. The rung lock mechanism as shown locks a rung in the basins of the hook part of a pair of aligned single hook key slots, and if additional pairs of aligned single hook key slots are used they are spaced to engage other rungs and they will also be locked into their respective single hook key slots. FIGS. 1, 2 3, 4, 5, 7, 8, 11 and 12 show an embodiment of a rung lock mechanism 17 that may be used with the accessory. In the embodiment shown the lock mechanism pivots from a closed position to an open position and then back to a closed position to secure a rung in the basin of a pair of single hook key slots that are aligned with each other in opposite side walls 29 and 30 as shown in the sequence of FIGS. 7 and 11. As previously mentioned when the rung that engages the single hook key slots is secured with the rung lock mechanism 17, any other rungs that are seated in a pair of single hook key slots will automatically be secured in their respective pair of single hook key slots. FIGS. 1, 7, 8 and 11 can be referred to as illustrating how the spring activated lock mechanism 17 of the present embodiment functions. When the accessory 10 is placed between and parallel to the ladder rails and seated on three rungs of a ladder and the pairs of single hook key slots 12 on each of the side walls are contacted the lock keys 33 and 33*a* (firmly attached and spaced through use of handle 32) of the lock mechanism are depressed because of being pivotally attached to the side wall 29 and 30 as illustrated in FIG. 7. This is done automatically by the force of the rung. Once the rungs are slid into the basin of the hook portion of single hook key slots 12, the spring activated lock mechanism 17 pivots to a closed position as shown in FIGS. 8 and 11, thus securing the accessory onto the ladder. To release, the handle 32 of the lock mechanism is pulled up toward the top face 31 (pivoted upward) as shown in FIG. 7 to pivot and raise the two lock keys 33 and 33*a*, opening the hook key slot and the rungs are detached the single hook key slots. The handle 32 is pulled upward for example by a worker reaching through one of the openings 12 formed in the top face 31 of the accessory. In this embodiment the rung lock mechanism is spring loaded 22 and pivots from pivot points 23 and 23*a*. The lock mechanism 17 is attached to the side walls of the accessory at the pivot points 23 and 23*a* in any suitable manner that allows the lock keys of the lock mechanism to move (pivot) up and down. The pivoting function can be provided for example by having the lock keys 33 and 33*a* define holes at the end opposite to the locking end. Matching and aligned holes are also provided in the side walls and bolt and lock nut combination for example are used to pivotally attach the lock mechanism to each side wall. Bolt/nut/washer combination, rivets or other suitable attaching means can be employed. Other locking mechanisms can the used, such as sliding locks, ratchet mechanisms and the like.

Figure 5:
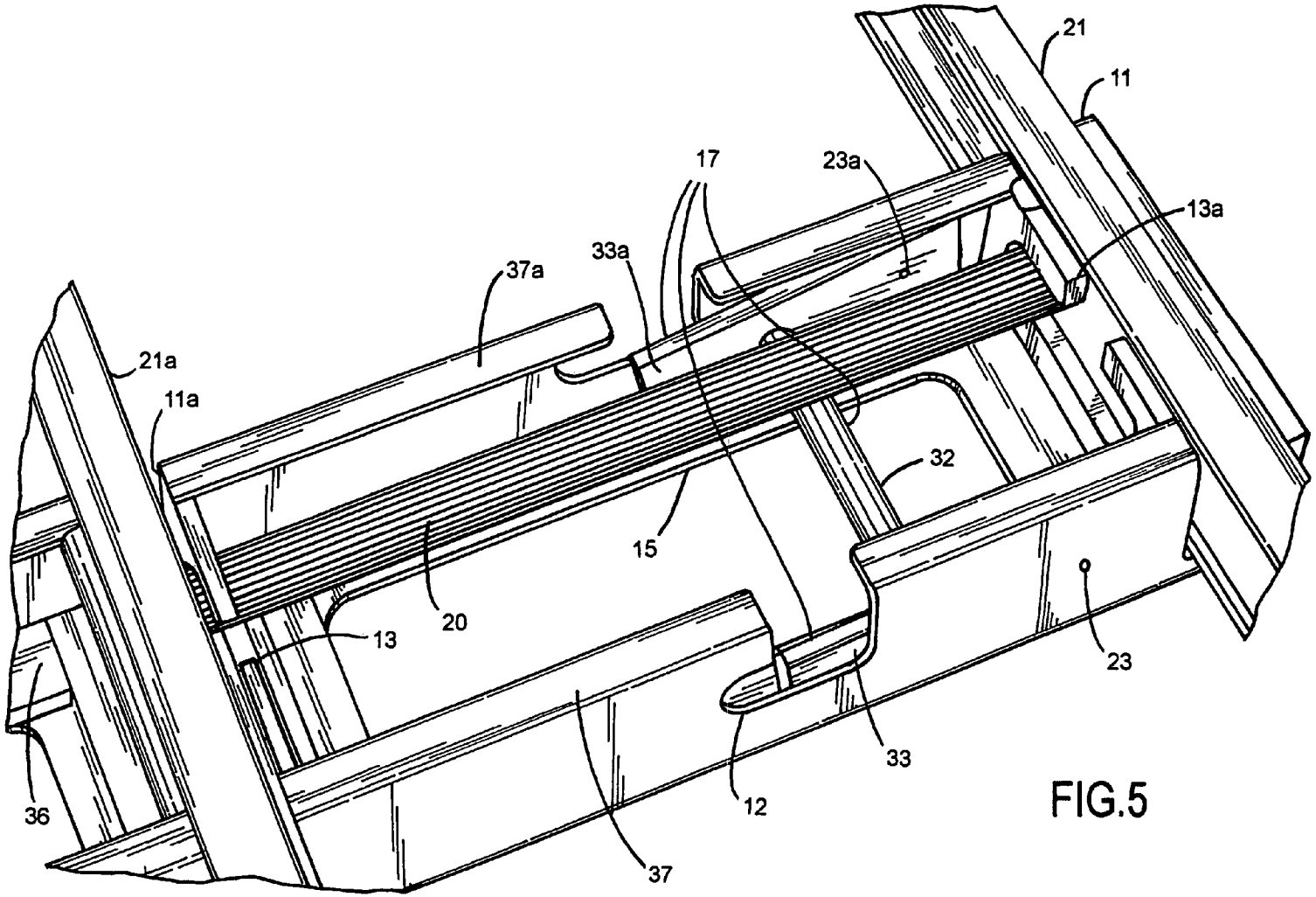
FIG. 5 is a close-up bottom view of a portion of one end of the accessory showing it engaged with a ladder through use of the rail channels 11, 11*a* and ladder rails 21, 21*a* and one ladder rung 20 of a ladder through aligned double hook key slots 13, 13*a* formed in the inner walls 26 and 27 of the rail channels in the position it would be to extend perpendicularly horizontally out from the ladder and lay on a roof.

FIG. 5 illustrates the rung lock mechanism is depressed by a rung of a ladder when the accessory is attached to the ladder in the working mode.

Figure 6:
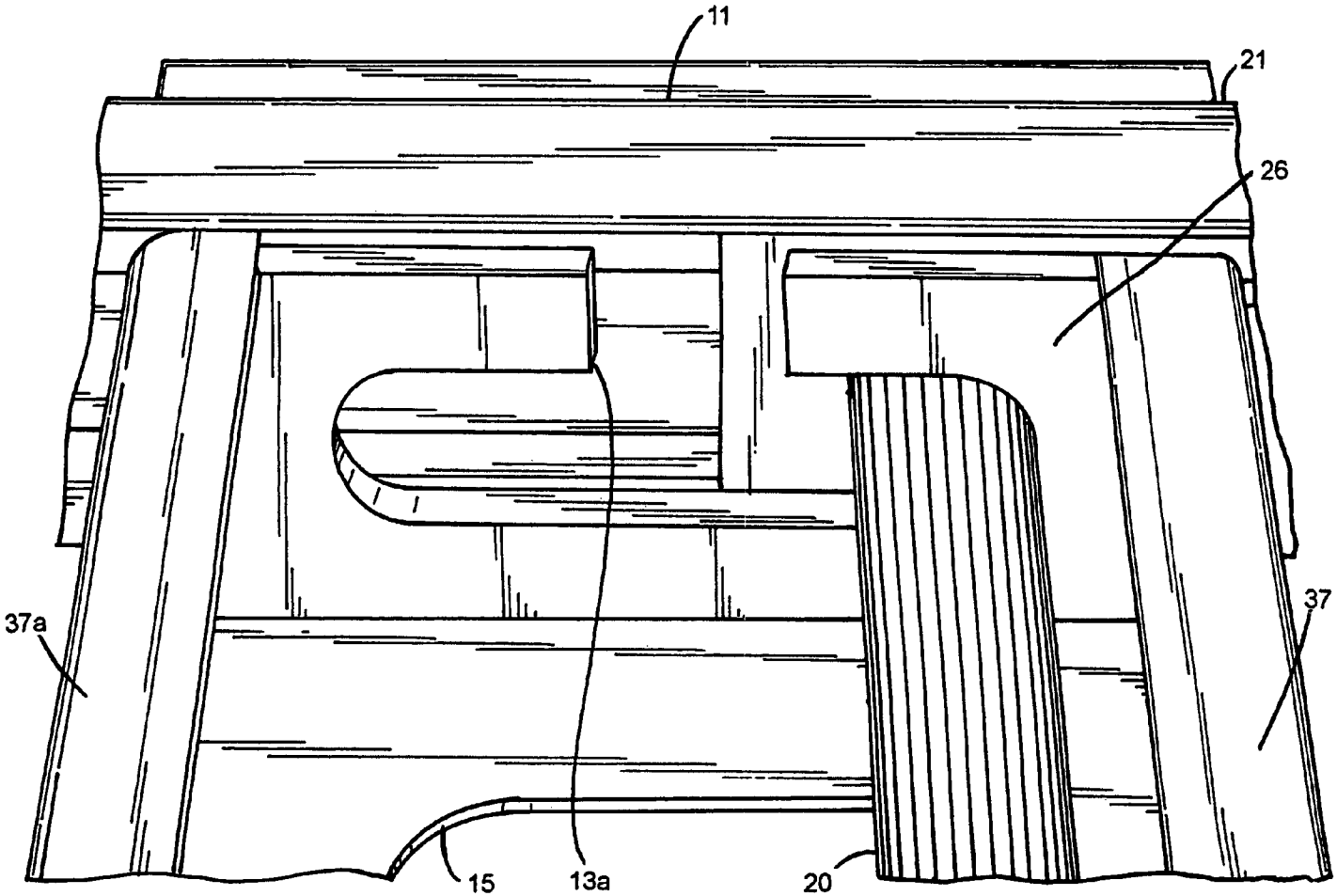
FIG. 6 is a close-up bottom view of a portion of the accessory showing detail of a rung 20 that is engaged in one of the pair of double hook key slots when the accessory is engaged with a ladder as shown in FIG. 5. The rung will be engaged with the other double hook key slot in a similar manner.

FIG. 6 shows a close-up of the rung 20/double hook key slot 13 engagement when the accessory is attached to the ladder in a working mode. The double hook key slots 13 and 13*a* make it possible to mount the accessory so it extends from either the left or right side of a ladder.

Figure 9:
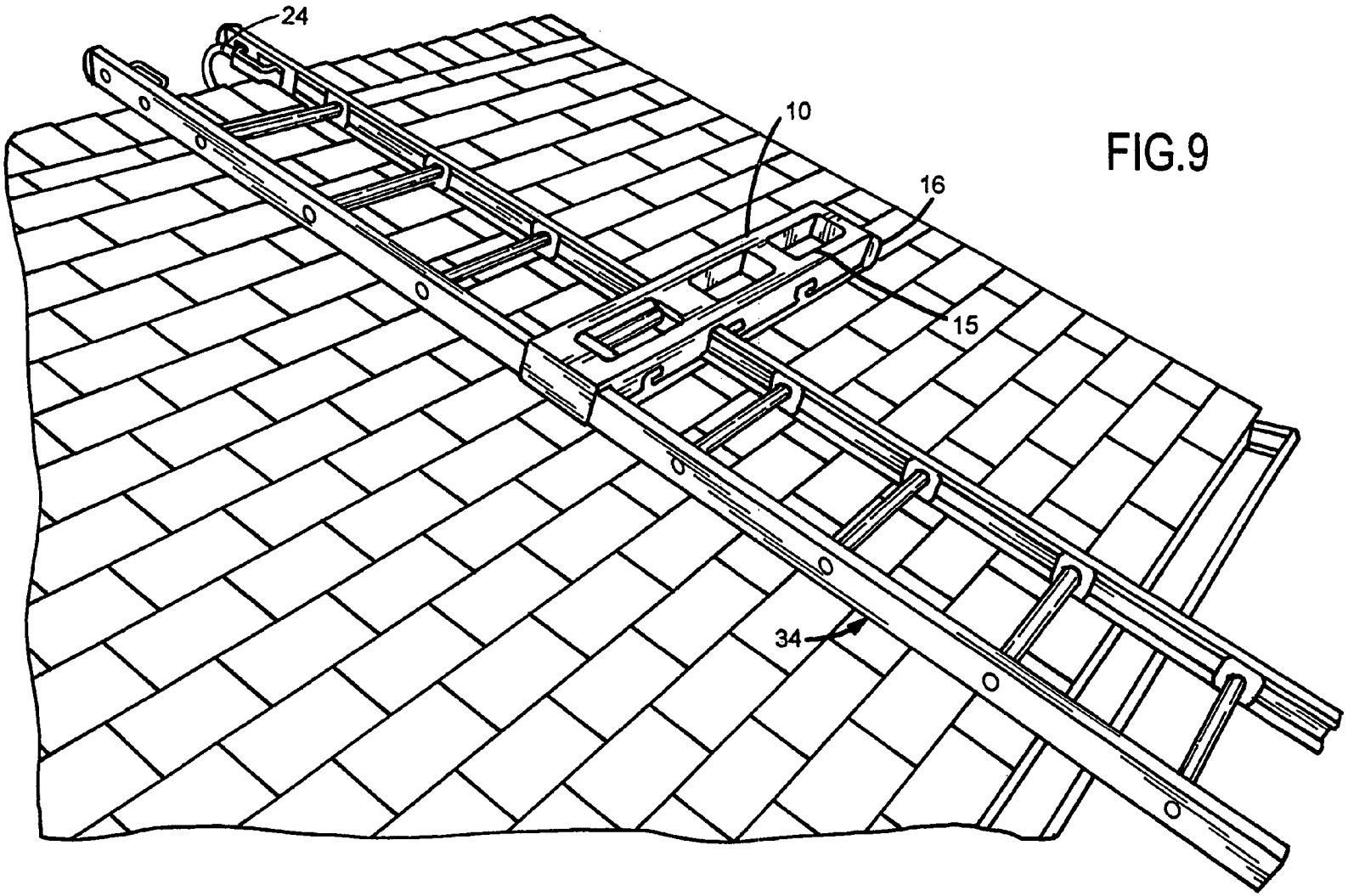
FIG. 9 illustrates a top view of the accessory engaged with a ladder in the working mode lying on a pitched roof and secured at the peak of the roof with hooks 24.
Figure 10:
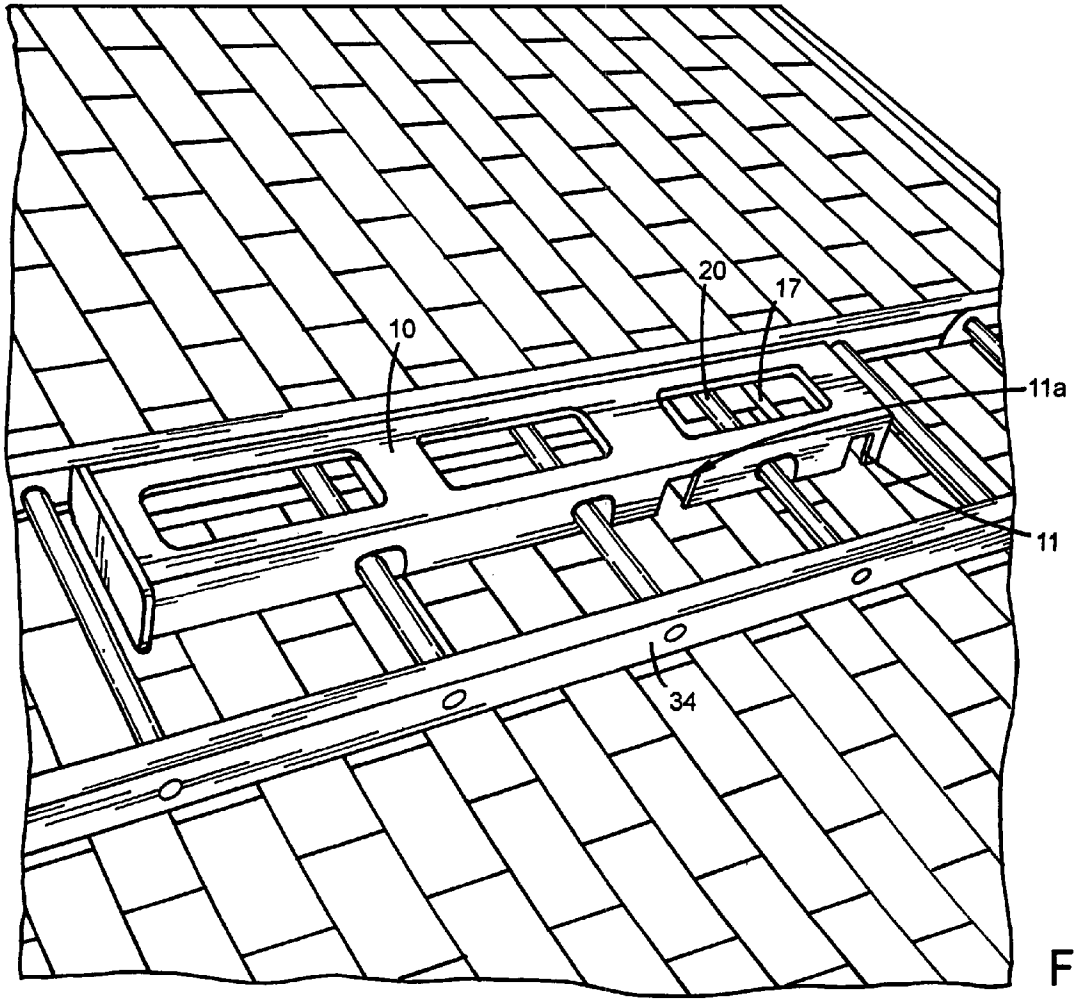
FIG. 10 illustrates a top view of the accessory engaged with a ladder in the carrying mode where the accessory is affixed to the ladder by 3 rungs, in this embodiment, and running parallel to the ladder rails. One embodiment of the rung lock mechanism 17 is shown for example in the FIGS. 8 and 11 and 12.

When the accessory 10 is attached to a ladder 34 that is hung from the peak or edge of the roof as shown in FIG. 9, for example, the bottom lower surface of the accessory (lower edges of the side walls or lips extending from the lower edges) rests on the surface of the roof and the accessory 10 extends essentially perpendicularly out from the side of the ladder rails. This allows a firefighter or worker to have a firm place of support upon which to brace himself when working on a pitched roof. Standard peak hook devices 24 can be employed to secure the ladder to the peak of a roof.

The accessory 10 is preferably made of metal. In one embodiment the step is constructed of three sixteenth inch or one quarter inch thick 6000 series extruded aluminum and the parts such as rail channel inner and outer walls, braces (except for the locking mechanism), and the rectangular box structure are welded together to provide a stiff and secure accessory having the elongated box structure. Readily available stock aluminum shapes can be used to manufacture the accessory. The thickness of the construction materials can vary and is sufficient to provide a stiff rigid construction that will not bend or break under normal use. Other techniques of fastening the parts together can be employed such as bolt and nut, arc welding, spot welding and the like.

The FIG.s also show that the outside surfaces of the accessory may be covered with non-skid elements 18. The elements 18 reduce the chance that a firefighter or other person using the invention to rest his or her foot could slip; thereby increasing their safety when using the accessory 10. Extruded aluminum sheet having a plurality of perforated buttons such as sold under the trademark "TRACTION TREAD" can be used. The accessory can also be provided with a non skid surface.

Figure 12:
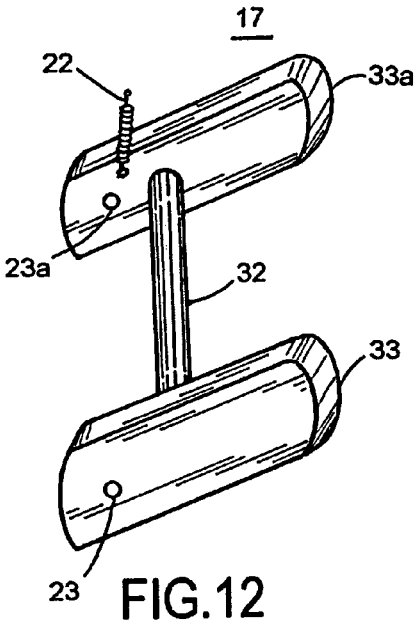
FIG. 12 illustrates one embodiment of the rung lock mechanism 17, shown in other Figures.

FIG. 12 illustrates an embodiment of a lock mechanism 17 that can be used. It comprises two lock keys 33 and 33*a*, which are securely spaced apart a distance preferably slightly less than the inside width of the accessory and fastened to a handle 32. The handle can be welded or otherwise firmly attached to the two lock keys. The two keys define holes 23 and 23*a* for pivotally attaching the mechanism to the side walls 29 and 30. The mechanism in this embodiment includes a spring 22 for maintaining the mechanism in a closed position when the accessory is attached to a ladder in the carrying mode. The lock keys have a length such that when the mechanism is pivotally attached to the side walls and is in a closed position for example in FIGS. 1, 3, 8 and 11 they will hold a ladder rung sitting in the hook portion of a pair of hook key slots 12 (for example single or double hook key slots) in place until the lock keys of the rung lock mechanism is pivoted up toward the top face of the accessory to open the hook key slots and the rung can be removed from the hook key slots.

In some of the embodiments internal braces are welded to the interior of the box to provide further stiffness and rigidity. Also as shown in Figures the bottom of the side walls 29 and 30 can be provided with lips 37 and 37*a* that run along the bottom edge of the side walls to further strengthen the structure. The lips can be added as separate parts or bent into the side walls when the box structure is formed.

Figure 13A:
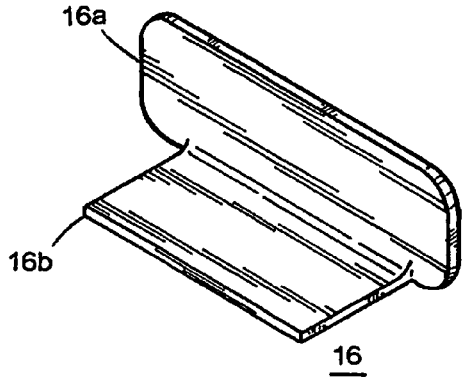
FIGS. 13*a*, 13*b*, 13*c*, and 13*d*, illustrate embodiments of various individual parts of the accessory that are preformed prior to attaching them into the elongated rectangular box structure to form the final accessory. Shown are.
Figure 13B:
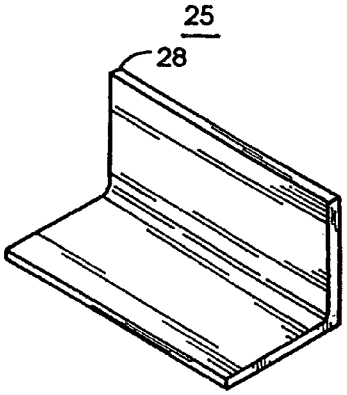
Figure 13C:
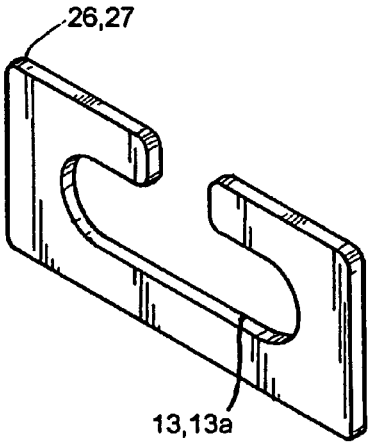
Figure 13D:
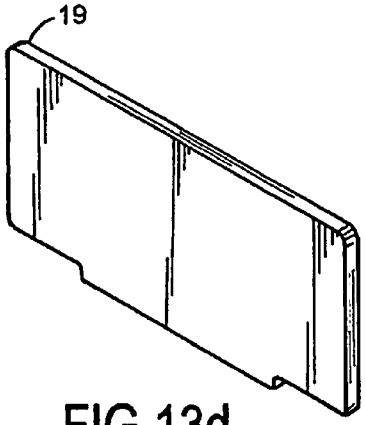

FIG. 13*a* illustrates the shape of a pre formed foot guard 16 which is welded or otherwise attached to the at least one end of the box structure extending out from the ladder. It comprise a vertical flat portion 16*a* that fits on the open end of the box structure and an flat extension 16*b* perpendicular to the vertical portion that is used to assist in attaching (such as by welding) the part 16 to the under side of the top face of the box structure. When the accessory 10 is built to extend from both sides of a ladder a foot guard is preferably affixed to both ends of the box structure. FIGS. 13*b*, 13*c* and 13*d* illustrate other parts that can be preformed and attached to the box structure to prepare the accessory. These are more completely described in the EXAMPLE.

For the purpose of the following claims a roof ladder may include a standard fire fighting ladder or other ladder and can be provided with grappling or hook means which allows the ladder to be easily hung from the ridge of a roof. Standard grappling means as known in the art can be used as well as standard ladders made for fighting fires or other uses.

EXAMPLE

A specific embodiment of the invention was prepared in the following manner. The accessory 10 was made to fit onto a standard fire ladder having the following dimensions: rail width—1.25 inch; rail height—3.25 inch; rung diameter 1.25 inch; rung spacing 14 inches on center; width between rails—19 inches measured inside to inside of the rails. The rail length was 10 feet.

Figure 3:
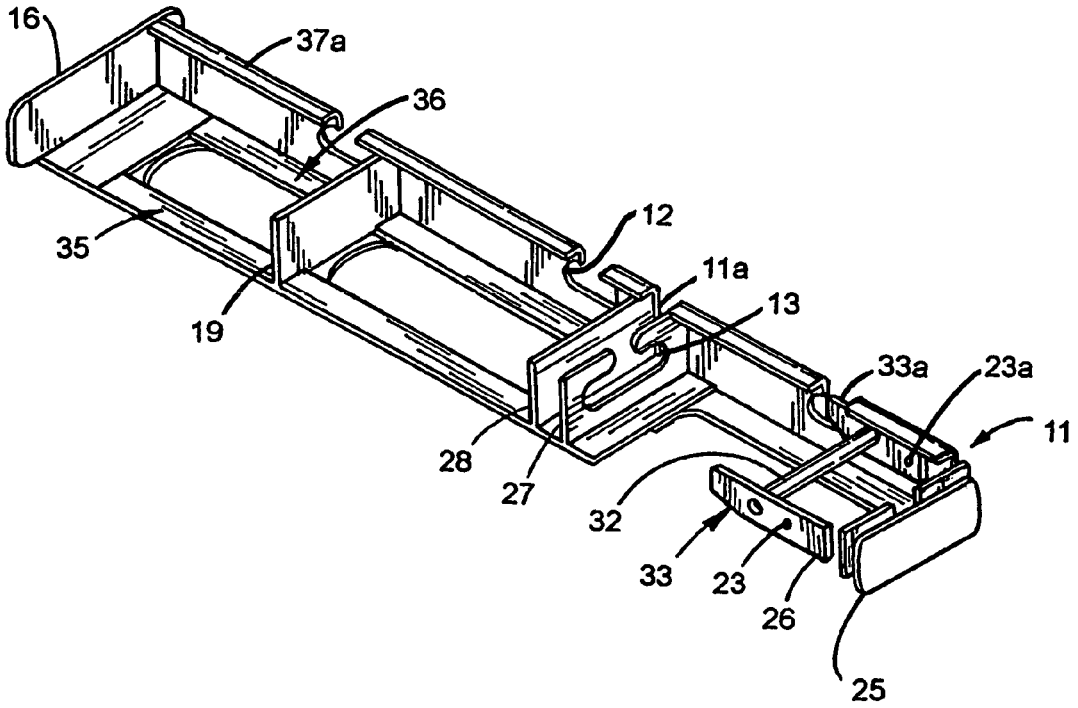
FIG. 3 illustrates an isometric cut away bottom view showing some of the details of the internal structure of the accessory 10, for example the location of braces, lock mechanism, lips and foot openings. In this embodiment the outer wall 25 of rail channel 11 is also the same shape and size as the foot guard 16 making for efficiency in manufacturing of the accessory.
Figure 4:
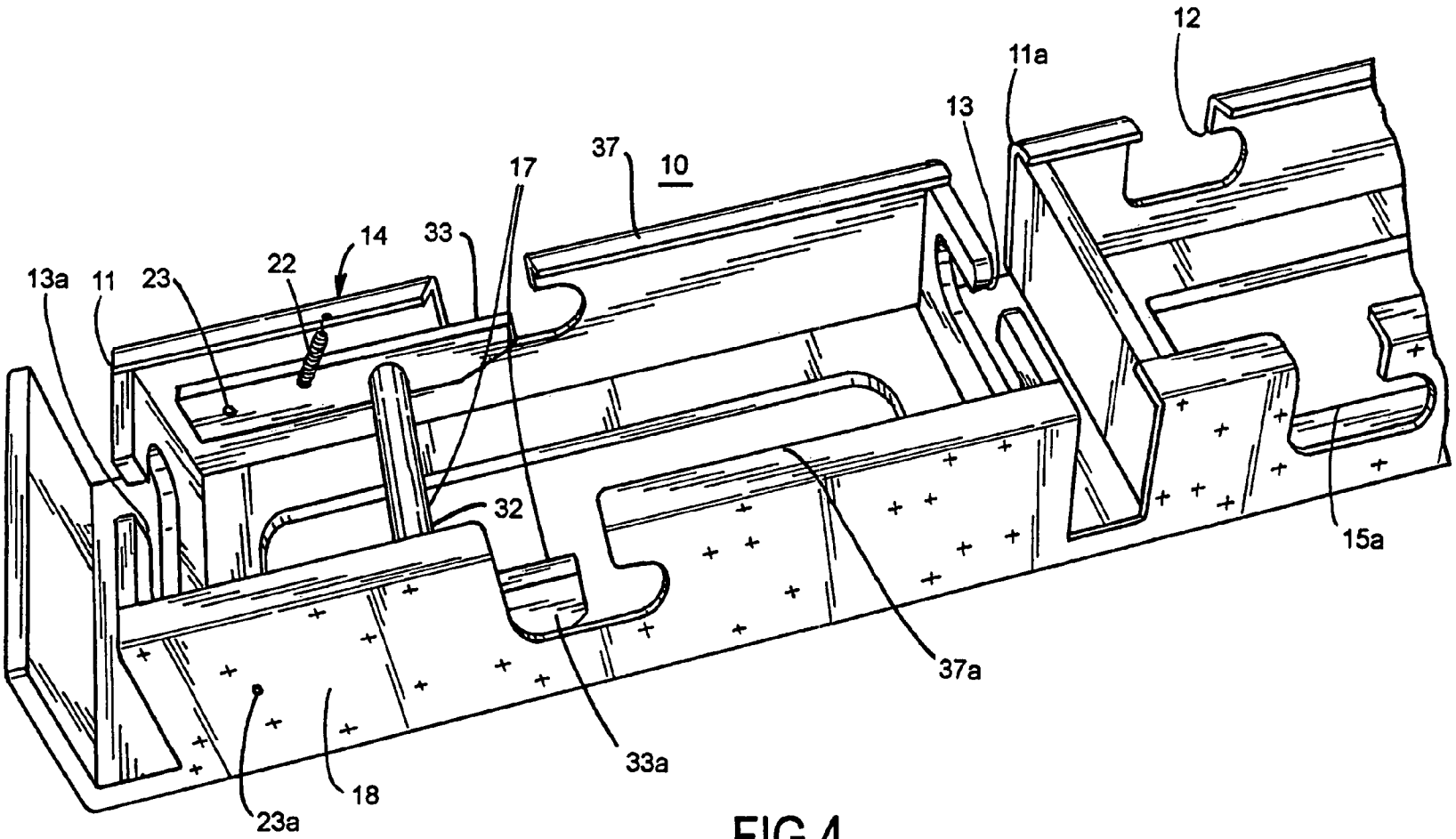
FIG. 4 is a close-up bottom view of a portion of the accessory illustrating the ladder rail channels, a locking mechanism, and single and double hook key slots.

The metal used to construct the accessory was 0.25 inch thick extruded aluminum. A flat sheet of the aluminum having the dimensions sixteen by forty eight inches was use as a starting point. Three openings (two were 12.5 inches long and one was 7 inches long and all were 4 inches wide): 3 sets of single hook key slots (three in each side wall), and spaces for rail channels were cut from the flat sheet using a water jet. The two rail channels (each having a width of 1.625 inches) were located at one end of the structure as shown in the Figures. The basin of the hook portion of the single hook key slots faced toward the foot guard end of the accessory. The single hook key slots were cut on 14 inch on center spacing to match the distance between the rungs of the ladder. Each single hook key slot has a entrance (opening) that was 1.875 inches wide, a width at the hook portion of 2.75 inches and depth of 3 inches from the bottom of the side walls to the base of the hook portion. The flat sheet was bent to form two side walls and two lips (0.875 inch wide) running along the bottom edge of the side walls with openings for the entrance for hook key slots and rail channels to prepare the rectangular open box structure. Various reinforcing elements (braces) added to strengthen the accessory, inner and outer channel walls and bottom, a locking mechanism 17 shown in the Figures and the foot support and other parts as illustrated in FIG. 13*a* through 13*d* were prepared also from 0.25 inch extruded aluminum. The parts, except for the locking mechanism, were welded into the box structure to form the final accessory shown in the Figures. The rung lock mechanism (shown in FIG. 12) was pivotally fixed to the inside of the side walls 29 and 30 of the box structure at the end between the two channels using bolt and lock nut combinations and a spring was attached to one lock key and the side wall to maintain it in a closed position when the accessory was engaged in the carrying mode with a ladder and the 3 sets of single key slots were fixed over 3 rungs of the ladder. The accessory had a height of 3.75 inches, a width of 7.125 inches, and a length of 48 inches. FIG. 3 illustrates the location of braces 35 and 36, brace 19 and foot guard 16. FIG. 13*a* illustrates the foot guard 16. The vertical portion 16*a* had a width of 10 inches and a height of 3.5 inches. The portion 16*b* had a width of 7.125 inches and extended out 3.5 inches. The portion 16*b* was used to assist in welding the foot guard to the end of the accessory by welding the portion 16*b* to the underside of the top face 31 of the accessory.

FIG. 12 illustrates the rung lock mechanism 17 used in the EXAMPLE. The lock keys 33 and 33*a* were 7.125 inches long and 1.5 inches wide. The handle was positioned 4.25 inches from the end of the lock key opposite to the locking end of the lock key. The handle had a diameter of 0.745 inches and was welded to the two lock keys to space them apart. A hole was drilled in the end of each lock key at the location 23 and 23*a* to provide means for pivotally attaching the lock mechanism to the side walls of the accessory. The rung lock mechanism could be reached through the opening located 15 located in the top face of the accessory.

FIG. 13*d* illustrates preformed part brace 19 (3.5 inches high by 7.125 inches wide); FIG. 13*a* illustrates the foot support 16 ; FIG. 13*b* illustrates the shape of the part used to form the outer walls of rail channel 25 and 28, and FIG. 13*c* illustrates the shape of the part used to form the inner walls 26 and 27 of the rail channels having the double hook key slots 13 and 13*a* formed therein. The perpendicular portion of the outer wall part of the rail channel figure forms the walls of the channel and the portion extending out from the perpendicular portion forms the top of the channels and is used to attach the part to the underside of the top face of the accessory. The outer walls of the rail channels had a height of 3.5 inches and a width of 7.125 inches and the portion extending out from the bottom had the same dimensions. The inner walls, 26 and 27, of the rail channels were 3.25 inches high and 7.125 inches wide. The double hook key slots had an entrance opening of 1.25 inches and a width across the bottom of 4.85 inches. Braces 35 and 36 shown in FIG. 3 were 24.75 inches long, 1.5 inch wide and 0.25 inch thick. The internal brace 19 had notches cut at the bottom to fit over the braches 35 and 36 and the remainder of the bottom fit against the inside face of the top face 31 of the accessory. The dimensions used to prepare the accessory of the EXAMPLE can be varied without departing from the invention. For example as shown in the FIGS. 1 and 2 the foot openings defined in the top face 31 are of equal length and width.

The above described embodiments of this invention are merely descriptive of its principles and are not to be limiting. The scope of this invention instead shall be determined from the scope of the following claims, including their equivalents.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

What is claimed is:

1. An accessory to be supported by it single ladder formed of rungs and two rails supporting said rungs comprising:

an elongated rectangular open box structure having a width, height and length and haying two side walls, and a top face, said height being substantially the same height as the height of the rails of said ladder and said width being less than the distance between the rails of said ladder;

including in each side wall at least two hook key slots that in each wall are aligned directly opposite from each other to form two aligned pair of hook key slots and distanced from each other in each side wall and having a size to fit over and engage with two rungs of the ladder when the accessory is placed bottom side down over said rungs with the side walls running parallel to the rails of said ladder;

said box structure defining at least one set of two parallel ladder rail channels that run crosswise to the length of said box structure open to the bottom of said box structure and that are spaced apart a distance such that each of said channels can engage a different rail of said ladder to provide a secure fit;

each of said channels defining an inner wall and outer wall;

each inner wall facing each other and each defining one double hook key slot of it size and aligned with each other to engage a single rung of said ladder when the rail channels are placed over said rails hooking the rung and said ladder to said accessory; the floor of the double hook key slots being placed at is height such that when the accessory is engaged with the ladder rails and rung in a working mode the bottom of the accessory rests on the roof surface in substantially the same plane as the bottom of the rails of the ladder;

said accessory having a length that is greater than the width of the ladder thereby having a portion that extends essentially perpendicularly beyond the width of said ladder to provide a support when the rail channels and said double hook key slots are engaged with the rails and rung of the ladder, and said top face defining at least one opening sized to permit a human foot to rest within the opening, including, a releasable locking mechanism that locks the two rungs into said pair of hook key slots when engaged with said ladder such that the accessory can be carried on the ladder, said releasable locking mechanism comprising two lock keys pivotally connected one to each to the inside of the each side wall of said accessory, a handle extending and connected between each lock key and a spring connected to one of said lock keys and said side wall that maintains the locking mechanism in a closed and locked position with respect to said hook key slots.

2. The accessory of claim 1, wherein the hook key slots in the side walls are single hook key slots.

3. The accessory of claim 1, including a foot guard attached to one end of said accessory and extending beyond the width of said accessory to assist in preventing a person's foot from sliding off the end of said accessory when a person is standing on said side wall of said accessory.

4. An accessory to be supported by a ladder formed of rungs and two rails supporting said rungs comprising:

an elongated rectangular open box structure having a width, height and length and having two side walls, and a top face, said height being substantially the same as the height of the rails of said ladder and said width of said accessory being less than the distance between the rails of said ladder;

said box structure defining at least one set of two parallel ladder rail channels that run crosswise to the length of said box structure open to the bottom of said box structure and that are spaced apart a distance such that each of said channels can engage a different rail of said ladder to provide a secure fit;

each of said channels defining an inner wall and outer wall;

each inner wall facing each other and each defining a single double hook key slot of a size and aligned with each other to engage one rung of said ladder when the rail channels are placed over said rails thereby hooking the rung and said ladder to said accessory; the floor of the double hook key slots being placed at a height such that when the accessory is engaged with the ladder rails and rune in a working mode the bottom of the accessory rests on the roof surface in substantially the same plane as the bottom of the rails of the ladder;

each side wall of said accessory defining at least two hook key slots in each side wall which are aligned directly opposite from each other to form two aligned pair of hook key slots and distanced from each other in each side wall and having a size to fit over and engage with two rungs of the ladder when the accessory is placed bottom side down over said rungs with the side walls running parallel to the rails of said ladder;

a releasable locking mechanism positioned inside said box that locks two rungs into said pair of hook key slots positioned in said side walk when engaged with said ladder such that the accessory can be carried on the ladder, said releasable locking mechanism comprising two lock keys pivotally connected one each to the inside of the each side wall of said accessory, a handle extending and connected between each lock key and a spring connected to one of said lock keys and said side wall that maintains the locking mechanism in a closed and locked position with respect to said hook key slots;

said accessory having a length that is greater than the width of the ladder thereby having a portion that extends essentially perpendicularly beyond the width of said ladder to provide a support when the rail channels and said double hook key slots are engaged with the rails and rung of the ladder, and said top face defining at least one opening sized to permit a human foot to rest within the opening and provide access to said locking mechanism.

* * * * *